US007740373B2

(12) United States Patent
Yoon et al.

(10) Patent No.: US 7,740,373 B2
(45) Date of Patent: Jun. 22, 2010

(54) LED MODULE FOR ILLUMINATION

(75) Inventors: Young-Ro Yoon, Seoul (KR); Woo-Suk Kang, Seoul (KR)

(73) Assignee: Dae Shin Led Co., Ltd., Siheung-si (KR)

( * ) Notice: Subject to any disclaimer, the term of this patent is extended or adjusted under 35 U.S.C. 154(b) by 140 days.

(21) Appl. No.: 12/293,420

(22) PCT Filed: Mar. 13, 2007

(86) PCT No.: PCT/KR2007/001230

§ 371 (c)(1),
(2), (4) Date: Sep. 17, 2008

(87) PCT Pub. No.: WO2007/108600

PCT Pub. Date: Sep. 27, 2007

(65) Prior Publication Data

US 2009/0122514 A1 May 14, 2009

(30) Foreign Application Priority Data

Mar. 17, 2006 (KR) ..... 10-2006-0024716

(51) Int. Cl.
*F21V 11/00* (2006.01)
*H01J 1/62* (2006.01)

(52) U.S. Cl. ..... 362/235; 362/294; 362/84; 257/98; 313/503

(58) Field of Classification Search ..... 362/231, 362/235, 294, 84; 257/98, 100; 313/498, 313/502

See application file for complete search history.

(56) References Cited

U.S. PATENT DOCUMENTS

| | | | | |
|---|---|---|---|---|
| 6,331,063 | B1 | 12/2001 | Kamada | |
| 6,365,920 | B1 | 4/2002 | Abramov | |
| 6,614,103 | B1 | 9/2003 | Durocher | |
| 6,999,318 | B2 * | 2/2006 | Newby | 361/719 |
| 7,244,965 | B2 * | 7/2007 | Andrews et al. | 257/98 |
| 7,422,344 | B2 * | 9/2008 | Wu et al. | 362/184 |
| 7,593,236 | B2 * | 9/2009 | Chikugawa | 361/760 |
| 2005/0174544 | A1 * | 8/2005 | Mazzochette | 353/69 |
| 2007/0285930 | A1 * | 12/2007 | Chen | 362/373 |

FOREIGN PATENT DOCUMENTS

| | | | |
|---|---|---|---|
| KR | 20040027642 | A | 4/2004 |
| KR | 20050022820 | A | 3/2005 |

* cited by examiner

*Primary Examiner*—Ali Alavi
(74) *Attorney, Agent, or Firm*—Christensen O'Connor Johnson Kindness PLLC

(57) ABSTRACT

The present invention relates to an LED module for illumination, and more particularly, to an LED module for illumination capable of enhancing light emitting efficiency by having a light emitting structure, in which the thickness of an insulation substrate with an electrode pattern formed on a top portion thereof is minimized, a heat radiation substrate is formed by integrally attaching a radiator to a bottom surface of the insulation substrate, and LED elements are attached to the electrode pattern of the heat radiation substrate through silver epoxy with excellent heat conductivity as an adhesive agent, so that heat generated from the LED elements can effectively radiate through the radiator, white light is effectively generated from the light emitted from the LED elements, and the white light can be emitted to the outside maximally.

15 Claims, 3 Drawing Sheets

【Figure 1】
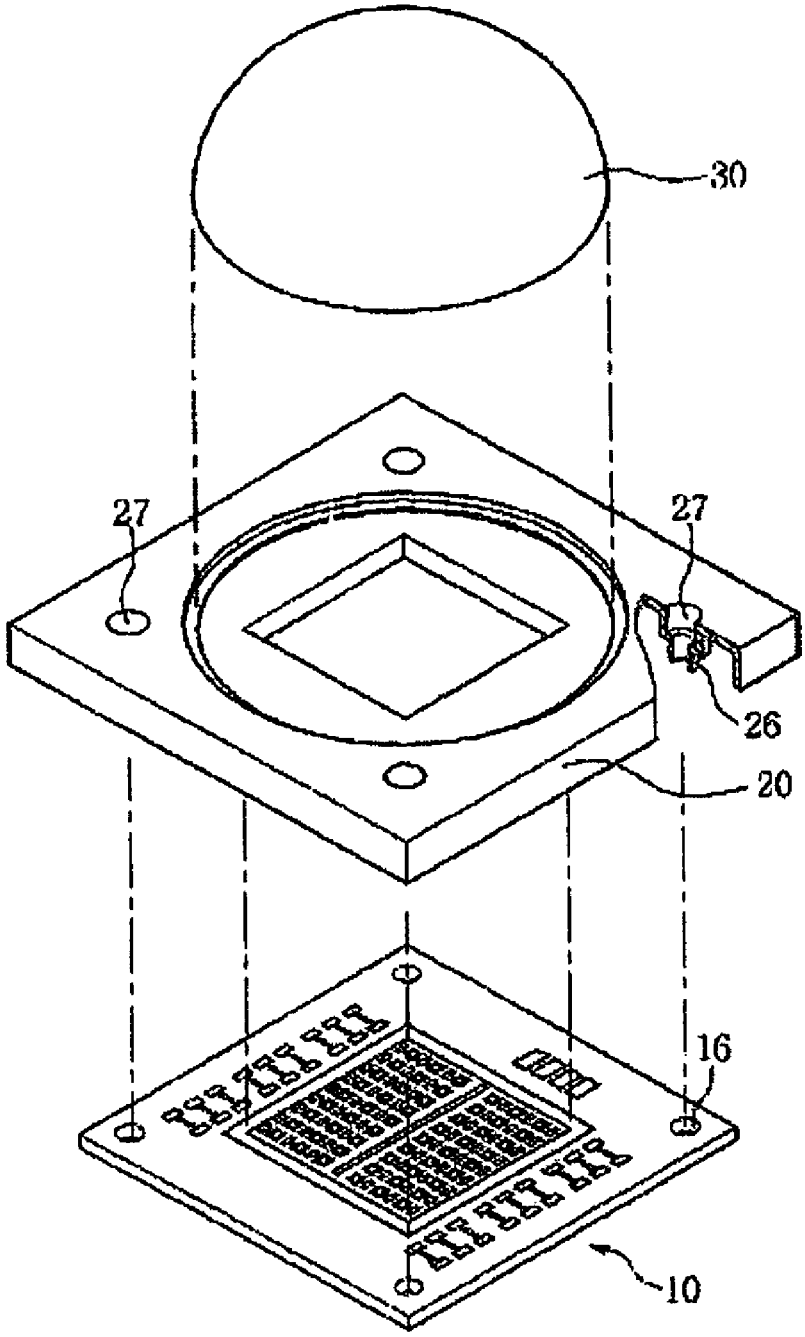

【Figure 2】
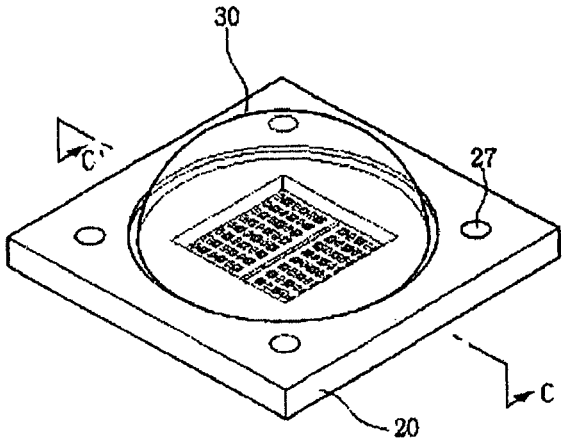
【Figure 3】
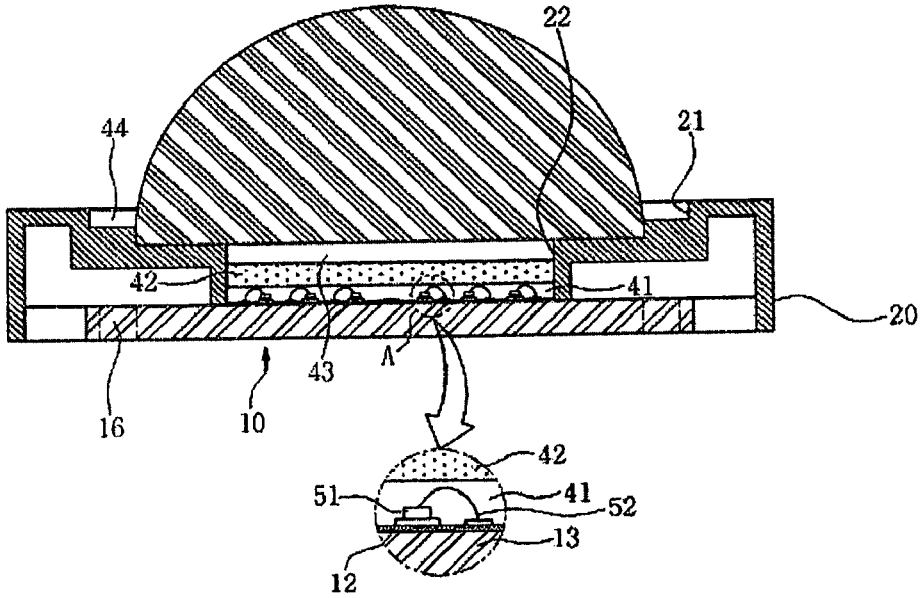
Detail of portion A

【Figure 4】
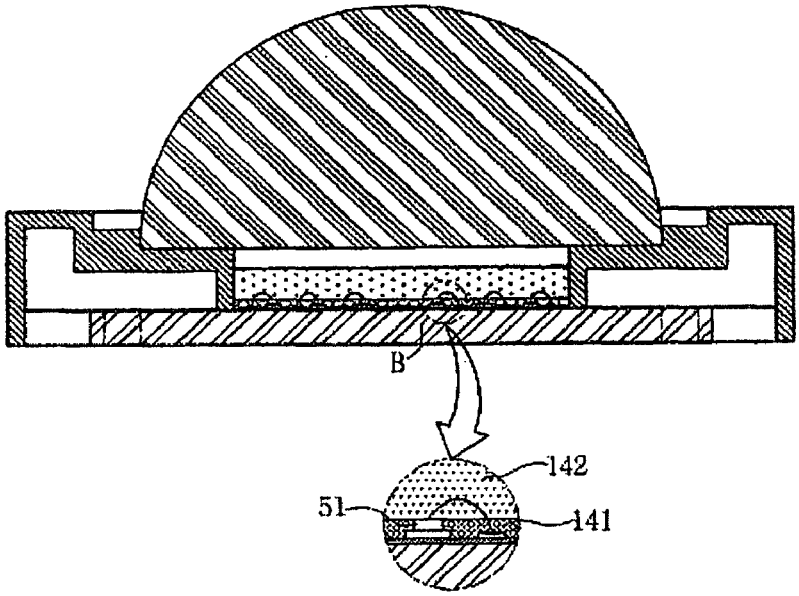
Detail of portion B
【Figure 5】
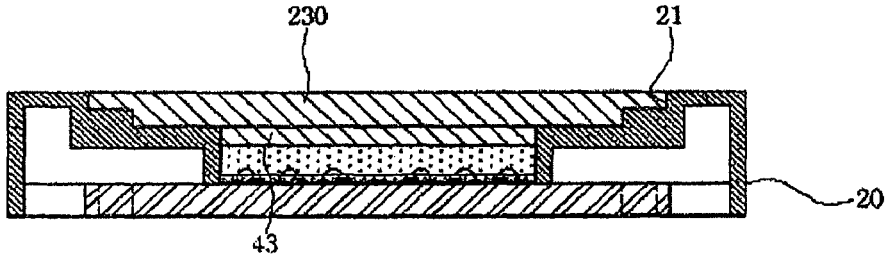

LED MODULE FOR ILLUMINATION

TECHNICAL FIELD

The present invention relates to an LED module for illumination, and more particularly, to an LED module for illumination capable of enhancing light emitting efficiency by having a light emitting structure, in which the thickness of an insulation substrate with an electrode pattern formed on a top portion thereof is minimized, a heat radiation substrate is formed by integrally attaching a radiator to a bottom surface of the insulation substrate, and LED elements are attached to the electrode pattern of the heat radiation substrate through silver epoxy with excellent heat conductivity as an adhesive agent, so that heat generated from the LED elements can effectively radiate through the radiator, white light is effectively generated from the light emitted from the LED elements, and the white light can be emitted to the outside maximally.

BACKGROUND ART

A light emitting diode (LED) has been developed using a characteristic in which a light emitting phenomenon occurs when a voltage is applied to a compound semiconductor. The LED is smaller than conventional light sources, and has a long life span and superior efficiency for converting electric energy into light energy. Particularly, as white LEDs with high luminance are commercialized by virtue of the development of semiconductor technologies, various lighting apparatuses using the white LEDs has appeared.

Especially, research and development have been actively conducted in relation to an LED module for illumination, in which a plurality of LED elements are integrated in a large scale to have a shape in which they are arranged in series and parallel, so that intensity of light per unit area, i.e., luminance, can be enhanced by a few thousands cd/m2 or more, thereby being illuminated at a sufficiently long distance.

However, as the integration scale of the LED module is increased, heat generated in the same area is also increased. For this reason, there is a problem in that an LED element may be damaged due to a large amount of heat generated from the LED element.

As a conventional LED module for illumination used to solve such a problem, there is an LED module capable of enhancing heat radiation performance by integrating LED elements on a metal printed circuit board (PCB) with a heat radiation effect superior to a general PCB. The metal PCB is a printed circuit board capable of enhancing heat radiation performance by attaching a flexible PCB formed of a synthetic resin film to a top portion of a radiator made of a metal component with high thermal conductivity through an adhesive agent.

However, since heat transfer from the LED elements to the lower radiator is hindered by the flexible PCB with low thermal conductivity and the adhesive agent, which are positioned between the LED elements and the radiator, there is limitation to radiate a large amount of heat generated by integrating the LED elements in a large scale. Consequently, there is a problem in that an LED element may be damaged due to heat generated in light emission.

DISCLOSURE

Technical Problem

The present invention is conceived to solve the aforementioned problems of an LED module for illumination according to the aforementioned prior art. That is, an object of the present invention is to enhance heat radiation performance of an LED module for illumination integratedly arranged in a large scale to generate light with high luminance required for illumination by minimizing the thickness of an insulation substrate with an electrode pattern formed on a top portion thereof, forming a heat radiation substrate by integrally attaching a radiator to a bottom surface of the insulation substrate, and attaching LED elements to the electrode pattern of the heat radiation substrate through silver epoxy with excellent heat conductivity as an adhesive agent.

Another object of the present invention is to enhance light emitting efficiency of an LED module by having a light emitting structure in which white light is effectively generated from light emitted from LED elements, and the white light can be emitted to the outside maximally.

Technical Solution

As the technical spirit for achieving the object, the present invention provides an LED module used for illumination according to the present invention, comprising: a heat radiation substrate including an insulation substrate having an electrode pattern formed thereon and a radiator integrally bonded to a lower portion of the insulation substrate; a plurality of LED elements mounted on the heat radiation substrate; a case having a hollow portion formed therein, the hollow portion passing through top and bottom surface of the case, the heat radiation substrate being attached to the bottom surface of the case, thereby allowing the LED elements to be positioned in an interior of the hollow portion; and a lens provided on the case, wherein a lower light emitting film made of a transparent material, a phosphor film containing a phosphor and an upper light emitting film made of a transparent material are sequentially coated on a top surface of the heat radiation substrate positioned in the interior of the hollow portion.

ADVANTAGEOUS EFFECTS

In an LED module for illumination according to the present invention, there is an advantage in that thermal resistance between an LED element and a radiator is minimized to enhance heat radiation performance of the LED module, so that the life span of the LED element can be extended and maintenance costs of a device can be reduced.

Further, there is an advantage in that there can be provided an LED lighting apparatus with superior illumination performance considering power consumption by enhancing light emitting efficiency of the LED lighting apparatus.

DESCRIPTION OF DRAWINGS

FIG. 1 is an exploded perspective view of an LED module for illumination according to a first embodiment of the present invention.

FIG. 2 is a perspective view of the LED module for illumination shown in FIG. 1.

FIG. 3 is a sectional view taken along line C-C□ of the LED module for illumination shown in FIG. 2.

FIG. 4 is a sectional view of an LED module for illumination according to a second embodiment of the present invention.

FIG. 5 is a sectional view of an LED module for illumination according to a third embodiment of the present invention.

EXPLANATION OF REFERENCE NUMERALS FOR MAJOR PORTIONS SHOWN IN DRAWINGS

| | | | |
|---|---|---|---|
| 10: | Heat radiation substrate | 11: | Electrode pattern |
| 12: | Insulation substrate | 13: | Radiator |
| 16: | Mounting hole | 20: | Case |
| 21: | Lens groove | 22: | Hollow portion |
| 26: | Fixing pin | 27: | Screw insertion hole |
| 30: | Lens | 41, 141: | Lower light emitting film |
| 42, 142: | Phosphor film | 43: | Upper light emitting film |
| 51: | LED element | 52: | Wire |
| 230: | Plane lens | | |

Best Mode

Hereinafter, preferred embodiments of the present invention will be described in detail with reference to the accompanying drawings.

FIG. 1 is an exploded perspective view of an LED module for illumination according to the first embodiment of the present invention, FIG. 2 is a perspective view of the LED module for illumination shown in FIG. 1, and FIG. 3 is a sectional view taken along line C-C□ of the LED module for illumination shown in FIG. 2.

As shown in FIGS. 1 to 3, the LED module for illumination according to the first embodiment of the present invention comprises a heat radiation substrate 10 with LED elements 51 mounted thereon; a case 20 to which the heat radiation substrate 10 is attached and fixed to a bottom surface of the case; and a lens 30 formed on a top portion of the case 20.

The lens 30 is made of epoxy resin, glass or clear silicon, which is a transparent material, to allow light emitted from the LED elements to be uniformly radiated to a space above the lens. The lens may have various shapes according to a radiation range and use.

The LED elements 51, each of which is a nitride-based blue LED element, emit white light since the LED elements are coated with a phosphor film 42, which will be described below. Any one of LED elements including a structure in which a semiconductor thin film is grown on a sapphire substrate that is an insulation substrate or on a metal alloy substrate such as a GaN substrate may be used as the LED element. However, an LED element including a structure of a metal alloy substrate with superior thermal conductivity is used in this embodiment, so that heat generated from the LED elements 51 can be effectively radiated to a lower radiator through a metallic substrate formed under the LED elements.

The heat radiation substrate 10 is a substrate, which is provided with a structure having an insulation substrate 12 with an electrode pattern 11 made of Cu formed on a top portion of the heat radiation substrate and a radiator 13 adhering to a lower portion of the insulation substrate such that heat radiation performance is enhanced. The heat radiation substrate 10 is formed with four mounting holes 16 through which fixing pins 26 of the case, which will be described below, are respectively inserted.

Here, it is preferred that the thickness of the insulation substrate 12 be minimized to be 35 μm or less, so that the heat generated from the LED elements 51 can be better transferred to the radiator 13.

Further, the electrode pattern 11 is formed on the insulation substrate 12 in a matrix form in which serial and parallel structures of combinations of positive and negative electrodes are mixed. In a case where an LED element provided with a structure of a metal alloy substrate is used as described in this embodiment, the LED element is mounted on each of the negative electrodes, and the positive electrode and the LED element 51 are connected to each other through a wire 52 to allow electricity to be conducted. Here, silver epoxy with excellent thermal conductivity is used in bonding the LED element 51 to the electrode pattern 11, so that the heat generated from LED element 51 can be effectively transferred to the heat radiation substrate 10.

The case 20 is formed in the shape of a hexahedron, in which a lens groove 21 for allowing the lens 30 to be seated thereon is formed on a top surface of the case and a rectangular hollow portion 22 vertically passing through a central portion of a bottom of the lens groove 21 from a lower surface of the case is formed in the case. The heat radiation substrate 10 can be attached to the lower surface of the case 20 by inserting the four fixing pins 26, which are formed in the shape of hollow cylinders on the four corners of the lower portion of the case, into the respective mounting holes 16 of the heat radiation substrate 10. Here, the hollow portion 22 is configuration such that all the LED elements 51 can be positioned in an interior of the hollow portion 22 when the heat radiation substrate 10 is attached to the lower surface of the case 20, so that the light emitted from the LED elements 51 can be emitted upward through the interior of the hollow portion 22 of the case 20.

In order to obtain white light most suitable for illumination from the LED element 51 of blue on the heat radiation substrate 10, a phosphor film containing phosphors is provided on a top surface of the LED element 51, so that white light is emitted by causing blue light emitted by the LED element 51 to be absorbed in the phosphor film as excitation light. In general, when the phosphors are cured to take shape, there are many cases where a large amount of phosphors sink downward, so that a density distribution of the phosphors is concentrated in a lower portion of the phosphor film. Therefore, if the phosphor film is formed directly on the top surface of the heat radiation substrate 10 to surround the LED element 51, a large amount of phosphors are distributed at side or lower portions of the LED element 51, and thus the generation efficiency of white light from blue light emitted upward from the top surface of the LED element 51 is relatively lowered.

In this embodiment, if the heat radiation substrate 10 is attached to the bottom surface of the case 20 and thus the top surface of the heat radiation substrate 10 and a lower end of an inner circumferential surface of the hollow portion are brought into contact with each other, a lower light emitting film 41 made of a transparent material is first coated on the top surface of the heat radiation substrate 10 positioned in the interior of the hollow portion 22 to surround the LED elements 51, a top surface of the lower light emitting film 41 is coated with the phosphor film 42 containing phosphors, so that the phosphors are positioned higher than the top surface of the LED elements. Accordingly, white light can be emitted effectively as compared with a case where the top surface of the substrate is immediately coated with the phosphor film.

Here, epoxy resin or clear silicon is used as a material of the lower light emitting film 41, so that the light emitted from the LED elements can be transmitted upward. However, if the epoxy resin is exposed by heat for a long time, there may occur a yellowing phenomenon in which a transparent color is yellowed. In a case where the epoxy resin is provided at a place continuously exposed to heat, a blooming agent should be previously added to the epoxy resin to compensate for discoloration due to the yellowing phenomenon. For this reason, light transmittance lowers due to the additive that is a non-transparent material. Thus, it is preferred that clear silicon with light transmittance and thermal conductivity higher than epoxy resin be used as the lower light emitting film.

Meanwhile, white the light emitted upward through the phosphor film 42 passes through a void space between the phosphor film 42 and the lens 30 before being introduced into the lens 30 provided on the top portion of the case 20 and then emitted to a space above the lens. The light may be hindered from being transmitted into the lens 30 due to difference of media between the void space and the lens made of a transparent material. Therefore, an upper light emitting film 43 is formed by completely filling the space defined between a top surface of the phosphor film 42 and a bottom surface of the lens 30 with epoxy resin or clear silicon similar to the material of the lens 30, so that the difference of media can be minimized and thus the light transmission efficiency can be enhanced.

Screw insertion holes 27 respectively connected to the hollow portion of the fixing pins 26 are formed on the top surface of the case 20. Screws are fastened through the screw insertion holes 27 at positions where the LED module is attached, so that the case 20 can be stably fixed.

Various thermosetting resins may be used as a material of the case 20. Preferably, polycarbonate with excellent reflection performance for light and superior heat/impact resistance is used to allow the light emitted from the LED elements 51 to be effectively reflected.

Mode for Invention

Hereinafter, an LED module for illumination according to a second embodiment of the present invention will be described with reference to FIG. 4.

The LED module for illumination according to the second embodiment of the present invention has the same structure as the aforementioned first embodiment except the lower light emitting film 41.

FIG. 4 is a sectional view of the LED module for illumination according to the second embodiment of the present invention.

As shown in FIG. 4, in the LED module for illumination according to this embodiment, a lower light emitting film 141 is formed of not clear silicon as described in the aforementioned first embodiment but a reflective material with excellent reflectivity. Here, it is preferred that epoxy resin containing $Al_2O_3$ with superior reflectivity therein be used as the reflective material. Further, the lower light emitting film 141 is formed such that only a side surface of an LED element 51 is surrounded with the reflective material by adjusting a coating amount of the lower light emitting film such that a top surface of the lower light emitting film 141 is flush with the top surface of the LED element 51. Thus, blue light emitted from the top surface of the LED element 51 is introduced into a phosphor film 142 formed on the lower light emitting film without any interference, and a component emitted downward from the phosphor film 142 among the white light emitted using blue light as excitation light is again reflected upward due to the reflective material contained in the lower light emitting film 141 to thereby changed upward.

As such, the lower light emitting film 142 containing the reflective material is configured to surround the side surface of the LED element 51, so that the white light emitted through the phosphor film 142 from the blue light emitted from the LED element 51 can be concentrated upward, thereby more enhancing the light emitting efficiency.

Hereinafter, an LED module for illumination according to a third embodiment of the present invention will be described with reference to FIG. 5.

As shown in FIG. 5, in the LED module for illumination according to this embodiment, a plane lens 230 with a flat top surface is formed by removing the semi-spherical lens 30 from the LED module for illumination according to the aforementioned second embodiment and by filling an entire space of a lens groove 21 of a case 20 from a top surface of an upper light emitting film 43 coated on a phosphor film 42 with clear silicon or epoxy resin, which is a transparent material. The LED module for illumination is used as a lighting apparatus by easily attaching a surface of the plane lens 230 to a glass window, a glass door or the like.

Further, it will be apparent that such a modification may be identically applied to the aforementioned first embodiment.

The present invention described above is not limited to the aforementioned embodiments and the accompanying drawings. It will be apparent that those skilled in the art can make various substitutions, modifications and changes thereto without departing from the technical spirit of the present invention.

INDUSTRIAL APPLICABILITY

As described above, since an LED module for illumination according to the present invention is provided with a light emitting structure, in which the heat radiation performance of the LED module for illumination is enhanced to thereby extend the life span of an LED element, and the light emitting efficiency thereof can be enhanced to be capable of applying the LED module for illumination to an LED lighting apparatus with reduced maintenance costs and superior illumination performance considering power consumption.

The invention claimed is:

1. An LED module used for illumination, comprising:

a heat radiation substrate including an insulation substrate having an electrode pattern formed thereon and a radiator integrally bonded to a lower portion of the insulation substrate;

a plurality of LED elements mounted on the heat radiation substrate;

a case having a hollow portion formed therein, the hollow portion passing through top and bottom surface of the case, the heat radiation substrate being attached to the bottom surface of the case, thereby allowing the LED elements to be positioned in an interior of the hollow portion; and a lens provided on the case, wherein a lower light emitting film made of a transparent material, a phosphor film containing a phosphor and an upper light emitting film made of a transparent material are sequentially coated on a top surface of the heat radiation substrate positioned in the interior of the hollow portion.

2. The LED module as claimed in claim 1, wherein the case has a lens groove formed on a top surface thereof, and the lens is seated in the lens groove.

3. The LED module as claimed in claim 1, wherein the LED elements are attached on the electrode pattern.

4. The LED module as claimed in claim 3, wherein the LED elements are bonded using silver epoxy as an adhesive agent.

5. The LED module as claimed in claim 1, wherein the electrode pattern is formed in a matrix form in which serial and parallel structures are mixed.

6. The LED module as claimed in claim 1, wherein the hollow portion of the case is formed in the shape of a rectangle.

7. The LED module as claimed in claim 1, wherein the lower light emitting film is made of clear silicon.

8. The LED module as claimed in claim 7, wherein the lower light emitting film is coated to completely surround the LED elements.

9. The LED module as claimed in claim 1, wherein the lower light emitting film is made of epoxy resin containing $Al_2O_3$.

10. The LED module as claimed in claim 9, wherein the lower light emitting film is coated to completely surround side surfaces of the LED elements.

11. The LED module as claimed in claim 1, wherein the heat radiation substrate has two or more mounting holes passing through top and bottom thereof, and the case has fixing pins respectively formed at positions corresponding to the mounting holes of the heat radiation substrate to be inserted into the mounting holes.

12. The LED module as claimed in claim 1, wherein the insulation substrate is formed to have a thickness of 35 μm or less.

13. The LED module as claimed in claim 1, wherein the upper light emitting film is made of clear silicon.

14. The LED module as claimed in claim 1, wherein the upper light emitting film is formed so that a space between a top surface of the phosphor film and a bottom surface of the lens is completely filled with the upper light emitting film.

15. The LED module as claimed in claim 1, wherein the case has a circular lens groove formed on the top surface thereof, and the lens is a plane lens formed to have a flat top surface by filling the lens groove with the lens.

* * * * *